US008668524B2

(12) United States Patent
Lan et al.

(10) Patent No.: US 8,668,524 B2
(45) Date of Patent: Mar. 11, 2014

(54) ELECTRICAL CONNECTOR

(75) Inventors: Rong-Qin Lan, Guang-Dong (CN); Li-Jun Xu, Guang-Dong (CN); Ming-Han Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 36 days.

(21) Appl. No.: 13/459,077

(22) Filed: Apr. 27, 2012

(65) Prior Publication Data

US 2013/0288536 A1 Oct. 31, 2013

(51) Int. Cl.
*H01R 13/648* (2006.01)

(52) U.S. Cl.
USPC ..... 439/607.35

(58) Field of Classification Search
USPC ..... 439/607.35–607.4
See application file for complete search history.

(56) References Cited

U.S. PATENT DOCUMENTS

| | | | | |
|---|---|---|---|---|
| 5,725,386 | A * | 3/1998 | Davis et al. | 439/79 |
| 6,109,935 | A * | 8/2000 | Yang | 439/80 |
| 6,135,790 | A * | 10/2000 | Huang et al. | 439/79 |
| 6,554,648 | B2 * | 4/2003 | Shi et al. | 439/607.55 |
| 7,641,519 | B1 * | 1/2010 | Chen | 439/660 |
| 7,717,745 | B2 * | 5/2010 | He et al. | 439/607.23 |
| 7,744,382 | B2 * | 6/2010 | Zheng et al. | 439/79 |
| 7,744,418 | B2 * | 6/2010 | He et al. | 439/607.35 |
| 7,811,110 | B2 * | 10/2010 | He et al. | 439/218 |
| 7,878,827 | B2 * | 2/2011 | Yao et al. | 439/181 |
| 7,909,653 | B1 * | 3/2011 | Wan et al. | 439/660 |
| 7,942,704 | B2 * | 5/2011 | Ko et al. | 439/660 |
| 7,946,893 | B2 * | 5/2011 | Chen et al. | 439/660 |
| 7,959,450 | B1 * | 6/2011 | Wang et al. | 439/135 |
| 8,021,195 | B2 * | 9/2011 | He et al. | 439/638 |
| 8,033,841 | B2 * | 10/2011 | He | 439/108 |
| 8,109,790 | B2 * | 2/2012 | He et al. | 439/607.35 |
| 8,215,996 | B2 * | 7/2012 | Su et al. | 439/660 |
| 8,303,329 | B2 * | 11/2012 | Wu | 439/395 |
| 8,398,427 | B2 * | 3/2013 | Wu | 439/497 |
| 2009/0258539 | A1 * | 10/2009 | Zheng et al. | 439/607.41 |
| 2010/0159745 | A1 * | 6/2010 | Wan et al. | 439/607.11 |
| 2010/0240255 | A1 * | 9/2010 | He et al. | 439/607.35 |
| 2011/0070778 | A1 * | 3/2011 | Wan et al. | 439/660 |
| 2011/0159746 | A1 * | 6/2011 | He | 439/660 |
| 2011/0256764 | A1 * | 10/2011 | Wu | 439/607.01 |
| 2011/0269322 | A1 * | 11/2011 | He et al. | 439/78 |
| 2012/0021651 | A1 * | 1/2012 | Ho | 439/626 |
| 2012/0052709 | A1 * | 3/2012 | Ko | 439/345 |
| 2012/0052739 | A1 * | 3/2012 | Wang et al. | 439/660 |
| 2012/0252278 | A1 * | 10/2012 | Chang | 439/660 |
| 2012/0252279 | A1 * | 10/2012 | Lee et al. | 439/660 |
| 2013/0178115 | A1 * | 7/2013 | Ao et al. | 439/682 |

* cited by examiner

*Primary Examiner* — Ross Gushi
(74) *Attorney, Agent, or Firm* — Cheng-Ju Chiang

(57) ABSTRACT

An electrical connector includes a first insulating housing having an erect base board and an erect tongue board extending forwards from a front of the base board, flat terminals molded in the first insulating housing and having a contact portion and a first soldering tail which vertically projects under the base board, a second insulating housing assembled to a right side of the base board, and spring terminals molded in the second insulating housing and having a contact arm and a second soldering tail which vertically projects under the second insulating housing. The contact portions are exposed in a front of a right side of the tongue board and arranged at regular intervals along a vertical direction. The contact arms elastically project sideward out of the right side of the tongue board and are arranged at regular intervals along the vertical direction behind the contact portions.

12 Claims, 3 Drawing Sheets

ELECTRICAL CONNECTOR

BACKGROUND OF THE INVENTION

1. Field of the Invention

The present invention relates to an electrical connector, and more particularly to an electrical connector which is adapted for being vertically assembled on a circuit board placed levelly.

2. The Related Art

Generally, a traditional electrical connector is often horizontally assembled on a circuit board placed levelly so that results in a large area of the circuit board occupied by the electrical connector and is to the disadvantage of miniaturizing the circuit board. So, an electrical connector adapted for being vertically assembled on the circuit board placed levelly came with the tide of fashion.

The electrical connector generally includes an insulating housing, a plurality of electrical terminals and a shielding shell. The insulating housing has a base portion and a tongue portion protruding forward from a front of the base portion. Left and right sides of the tongue portion define a plurality of terminal grooves each extending rearward into the base portion and penetrating vertically through the base portion. Each electrical terminal has a fastening strip of inverted-L shape, a contact portion and a soldering tail formed from two free ends of the fastening strip. The electrical terminals are divided into two groups and assembled in the terminal grooves of the insulating housing, with the contact portions projecting beyond the left and right sides of the tongue portion and the soldering tails projecting under the base portion to be inserted in the circuit board. However, assembly clearance often exists among the electrical terminals and the insulating housing. As a result, the electrical terminals are apt to loose with respect to the insulating housing, when the electrical connector is connected with a mating connector. It often affects the electrical connection between the electrical connector and the mating connector.

SUMMARY OF THE INVENTION

An object of the present invention is to provide an electrical connector adapted for being vertically assembled on a circuit board place levelly. The electrical connector includes a first insulating housing, a plurality of flat terminals molded in the first insulating housing, a second insulating housing, a plurality of spring terminals molded in the second insulating housing, and a metal shell enclosing the first insulating housing and the second insulating housing. The first insulating housing has an erect base board and an erect tongue board extending forwards from a front of the base board. Each of the flat terminals has a contact portion and a first soldering tail. The contact portions are exposed in a front of a right side of the tongue board and arranged at regular intervals along a vertical direction. The first soldering tails vertically project under the base board and are arranged at regular intervals along a front-to-rear direction. The second insulating housing is assembled to a right side of the base board of the first insulating housing. Each of the spring terminals has a contact arm and a second soldering tail. The contact arms elastically project sideward out of the right side of the tongue board of the first insulating housing and are arranged at regular intervals along the vertical direction behind the contact portions of the flat terminals. The second soldering tails vertically project under the second insulating housing and are arranged at regular intervals along a front-to-rear direction. The first soldering tails of the flat terminals and the second soldering tails of the spring terminals are further projected under the metal shell to be inserted in the circuit board.

As described above, the flat terminals and the spring terminals are molded in the first insulating housing and the second insulating housing respectively, and then the insulating housings are assembled together, so that avoids an assembly clearance existing among the terminals and the insulating housings. So, the terminals are steady with respect to the insulating housings even if the electrical connector is connected with a mating connector, and a steady electrical connection is realized between the electrical connector and the mating connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
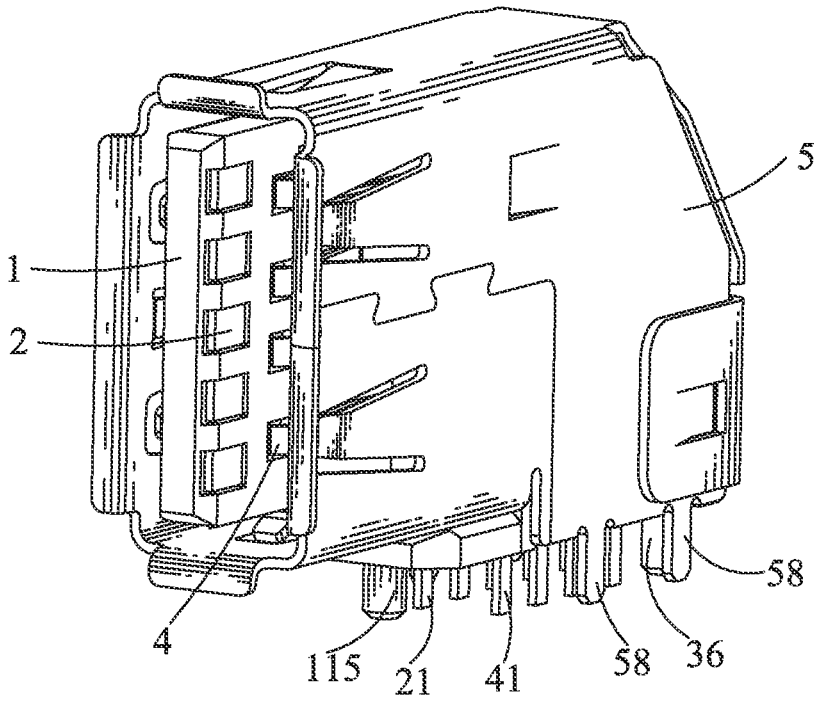
FIG. 1 is an assembled perspective view of an electrical connector in accordance with an embodiment of the present invention.
Figure 2:
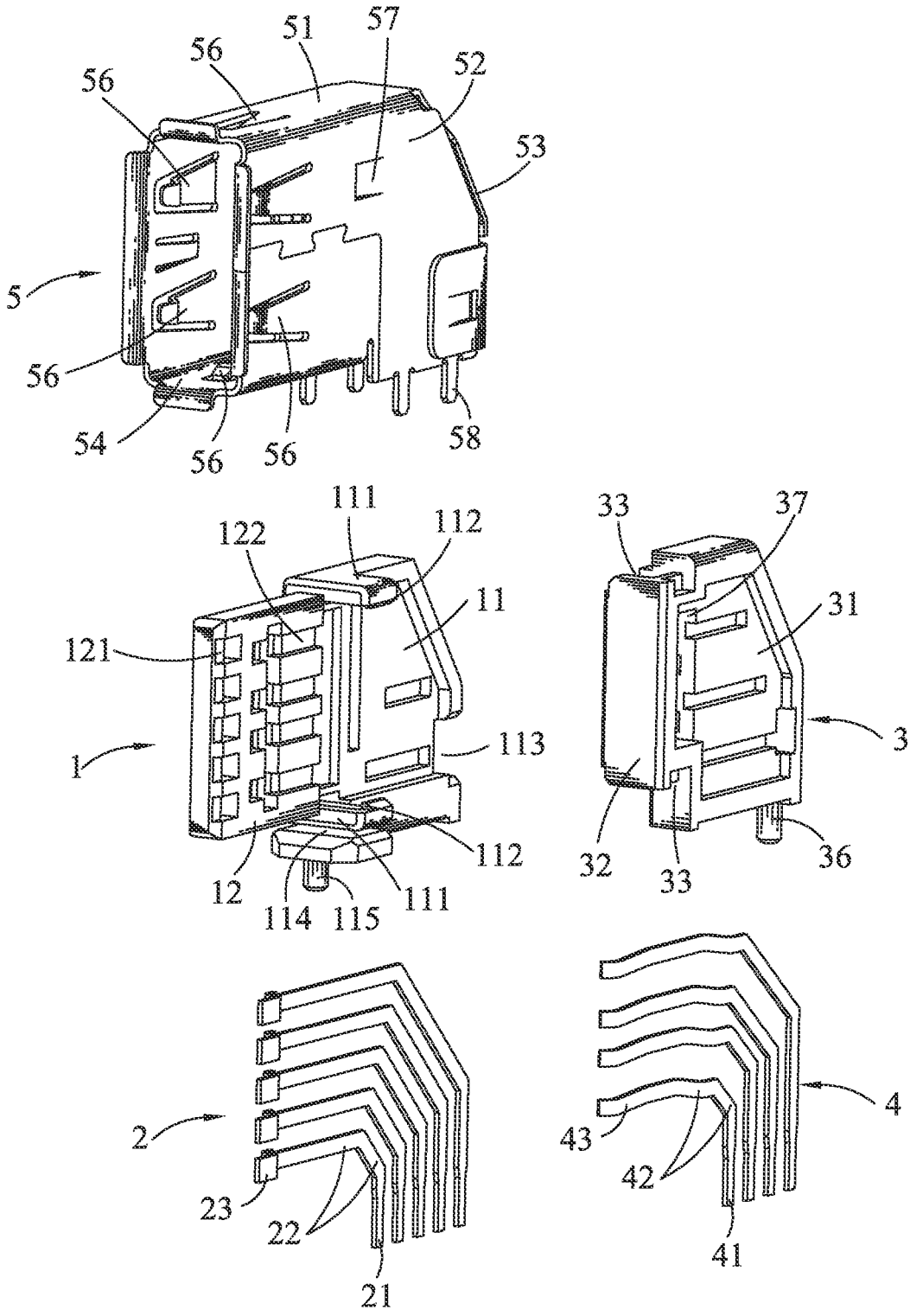
FIG. 2 and FIG. 3 are exploded perspective views of the electrical connector shown in FIG. 1.

Referring to FIG. 1 and FIG. 2, an electrical connector in accordance with an embodiment of the present invention is adapted for being vertically assembled on a circuit board (not shown) place levelly. The electrical connector includes a first insulating housing 1, a plurality of flat terminals 2 molded in the first insulating housing 1, a second insulating housing 3, a plurality of spring terminals 4 molded in the second insulating housing 3, and a metal shell 5 enclosing the first insulating housing 1 and the second insulating housing 3.

Figure 3:
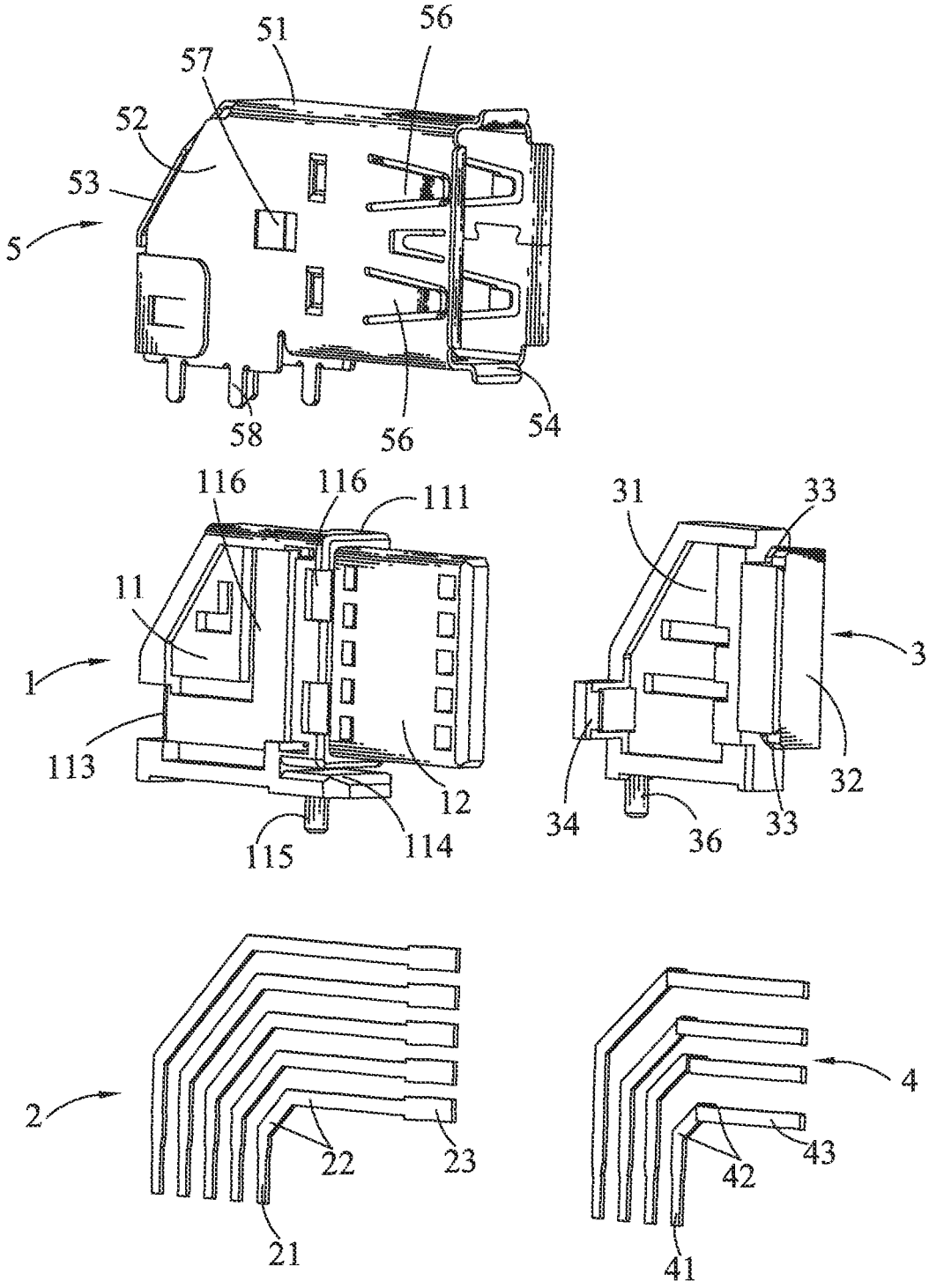

Referring to FIGS. 1-3, the first insulating housing 1 has an erect base board 11 and an erect tongue board 12 extending forwards from a front of the base board 11. Each of the flat terminals 2 has a contact portion 23 and a first soldering tail 21. The contact portions 23 are exposed in a front of a right side of the tongue board 12 and arranged at regular intervals along a vertical direction. The first soldering tails 21 vertically project under the base board 11 and are arranged at regular intervals along a front-to-rear direction. The second insulating housing 3 is assembled to a right side of the base board 11 of the first insulating housing 1. Each of the spring terminals 4 has a contact arm 43 and a second soldering tail 41. The contact arms 43 elastically project sideward out of the right side of the tongue board 12 of the first insulating housing 1 and are arranged at regular intervals along the vertical direction behind the contact portions 23 of the flat terminals 2. The second soldering tails 41 vertically project under the second insulating housing 3 and are arranged at regular intervals along a front-to-rear direction. The first soldering tails 21 of the flat terminals 2 and the second soldering tails 41 of the spring terminals 4 further project under the metal shell 5 to be inserted in the circuit board.

Referring to FIG. 2, the flat terminal 2 has a first fastening strip 22 curvedly connected between the contact portion 23 and the first soldering tail 21. The first fastening strip 22 has a horizontal part extending longitudinally with the contact portion 23 forming at a front end thereof in a horizontal step manner, a vertical part of which a bottom end extends downward to form the first soldering tail 21, and a slant part inclining forward to connect with a rear end of the horizontal part and a top end of the vertical part. The first fastening strips 22 are apart molded in the first insulating housing 1 with lengths of the horizontal parts, the slant parts and the vertical parts thereof lengthening by degrees from the bottom up and from front to back. The front of the right side of the tongue board 12 of the first insulating housing 1 defines a plurality of terminal fillisters 121 arranged at regular intervals along the vertical direction for exposing out the contact portions 23 of the flat terminals 2 therethrough.

Referring to FIG. 2 again, the spring terminal 4 has a second fastening strip 42 curvedly connected between the contact arm 43 and the second soldering tail 41. The second fastening strip 42 has a horizontal step part of which a front end extends forward and is inclined sideward to form the contact arm 43, a vertical part of which a bottom end extends downward to form the second soldering tail 41, and a slant part inclining forward to connect with a rear end of the horizontal step part and a top end of the vertical part. The second fastening strips 42 are apart molded in the second insulating housing 3 with lengths of the horizontal step parts, the slant parts and the vertical parts thereof lengthening by degrees from the bottom up and from front to back. A rear of the right side of the tongue board 12 of the first insulating housing 1 defines a plurality of terminal grooves 122 arranged at regular intervals along the vertical direction and each extending longitudinally for receiving the contact arm 43 of the spring terminal 4 therein.

Referring to FIG. 2 and FIG. 3, top and bottom of a front of the right side of the base board 11 of the first insulating housing 1 extend rightwards to form a pair of clamping boards 111 of which distal ends protrude towards each other to define a pair of buckling barbs 112. The second insulating housing 3 has a base portion 31 and a buckling portion 32 protruding forwards from a front of the base portion 31 to be clamped between the clamping boards 111 of the first insulating housing 1. Top and bottom of the buckling portion 32 define a pair of buckling grooves 33 for buckling the buckling barbs 112 therein. A rear end of the base portion 31 of the second insulating housing 3 protrudes leftwards to form a fastening block 34. A fastening gap 113 is opened in a rear end of the base board 11 of the first insulating housing 1 for fixing the fastening block 34 therein.

Referring to FIGS. 1-3 again, the metal shell 5 has a top plate 51, two side plates 52, a rear plate 53 and a bottom plate 54. The rear plate 53 is covered on backs of the first insulating housing 1 and the second insulating housing 3. The bottom plate 54 is connected between fronts of bottom edges of the side plates 52. The soldering tails 21, 41 of the flat terminals 2 and the spring terminals 4 project downward beyond the bottom plate 54 through the back of the bottom plate 54. A bottom end of the front of the base board 11 of the first insulating housing 1 is concaved rearward to form an insertion slot 114 penetrating transversely therethrough. The bottom plate 54 of the metal shell 5 is apart located under the tongue board 12 of the first insulating housing 1 with a rear end thereof being inserted in the insertion slot 114.

A left side of the base board 11 of the first insulating housing 1 and a right side of the second insulating housing 3 define a plurality of buckling fillisters 116, 37. The side plates 52 of the metal shell 5 are punched inward to form a plurality of buckling wedges 57 buckled in the buckling fillisters 116, 37 respectively. Rears of the bottom edges of the side plates 52 of the metal shell 5 protrude downward to form a plurality of fastening feet 58. Bottoms of the base board 11 of the first insulating housing 1 and the second insulating housing 3 protrude downward to form a fastening pillar 115, 36 respectively. The fastening feet 58 and the fastening pillars 115, 36 are inserted in the circuit board to secure the electrical connector erectly on the circuit board. The top plate 51, the side plates 52 and the bottom plate 54 of the metal shell 5 are die-cut inward to form a plurality of resisting arms 56.

As described above, the flat terminals 2 and the spring terminals 4 are molded in the first insulating housing 1 and the second insulating housing 3 respectively, and then the insulating housings 1, 3 are assembled together, so that avoids an assembly clearance existing among the terminals 2, 4 and the insulating housings 1, 3. So, the terminals 2, 4 are steady with respect to the insulating housings 1, 3 even if the electrical connector is connected with a mating connector (not shown), and a steady electrical connection is realized between the electrical connector and the mating connector.

What is claimed is:

1. An electrical connector adapted for being vertically assembled on a circuit board place levelly, comprising:

a first insulating housing having an erect base board and an erect tongue board extending forwards from a front of the base board;

a plurality of flat terminals each having a contact portion and a first soldering tail, the flat terminals being molded in the first insulating housing, the contact portions being exposed in a front of a right side of the tongue board and arranged at regular intervals along a vertical direction, the first soldering tails vertically projecting under the base board and being arranged at regular intervals along a front-to-rear direction;

a second insulating housing assembled to a right side of the base board of the first insulating housing;

a plurality of spring terminals each having a contact arm and a second soldering tail, the spring terminals being molded in the second insulating housing, the contact arms elastically projecting sideward out of the right side of the tongue board of the first insulating housing and being arranged at regular intervals along the vertical direction behind the contact portions of the flat terminals, the second soldering tails vertically projecting under the second insulating housing and being arranged at regular intervals along a front-to-rear direction; and a metal shell enclosing the first insulating housing and the second insulating housing, the first soldering tails of the flat terminals and the second soldering tails of the spring terminals further projecting under the metal shell to be inserted in the circuit board;

wherein top and bottom of a front of the right side of the base board of the first insulating housing extend rightwards to form a pair of clamping boards of which distal ends protrude towards each other to define a pair of buckling barbs, the second insulating housing has a base portion and a buckling portion protruding forwards from a front of the base portion to be clamped between the clamping boards of the first insulating housing, top and bottom of the buckling portion define a pair of buckling grooves for buckling the buckling barbs therein.

2. The electrical connector as claimed in claim 1, wherein the flat terminal has a first fastening strip curvedly connected between the contact portion and the first soldering tail, the first fastening strip has a horizontal part extending longitudinally with the contact portion forming at a front end thereof in a horizontal step manner, a vertical part of which a bottom end extends downward to form the first soldering tail, and a slant part inclining forward to connect with a rear end of the horizontal part and a top end of the vertical part.

3. The electrical connector as claimed in claim 2, wherein the front of the right side of the tongue board of the first insulating housing defines a plurality of terminal fillisters arranged at regular intervals along the vertical direction for exposing out the contact portions of the flat terminals therethrough.

4. The electrical connector as claimed in claim 1, wherein the spring terminal has a second fastening strip curvedly connected between the contact arm and the second soldering tail, the second fastening strip has a horizontal step part of which a front end extends forward and is inclined sideward to form the contact arm, a vertical part of which a bottom end extends downward to form the second soldering tail, and a slant part inclining forward to connect with a rear end of the horizontal step part and a top end of the vertical part.

5. The electrical connector as claimed in claim 4, wherein a rear of the right side of the tongue board of the first insulating housing defines a plurality of terminal grooves arranged at regular intervals along the vertical direction and each extending longitudinally for receiving the contact arm of the spring terminal therein.

6. The electrical connector as claimed in claim 1, wherein a rear end of the base portion of the second insulating housing protrudes leftwards to form a fastening block, a fastening gap is opened in a rear end of the base board of the first insulating housing for fixing the fastening block therein.

7. The electrical connector as claimed in claim 1, wherein the metal shell has a top plate, two side plates, a rear plate and a bottom plate, the rear plate is covered on backs of the first insulating housing and the second insulating housing, the bottom plate is connected between fronts of bottom edges of the side plates, the soldering tails of the flat terminals and the spring terminals project downward beyond the bottom plate through the back of the bottom plate.

8. The electrical connector as claimed in claim 7, wherein a bottom end of the front of the base board of the first insulating housing is concaved rearward to form an insertion slot penetrating transversely therethrough, the bottom plate of the metal shell is apart located under the tongue board of the first insulating housing with a rear end thereof being inserted in the insertion slot.

9. The electrical connector as claimed in claim 7, wherein a left side of the base board of the first insulating housing and a right side of the second insulating housing define a plurality of buckling fillisters, the side plates of the metal shell are punched inward to form a plurality of buckling wedges buckled in the buckling fillisters respectively.

10. The electrical connector as claimed in claim 7, wherein rears of the bottom edges of the side plates of the metal shell protrude downward to form a plurality of fastening feet, bottoms of the base board of the first insulating housing and the second insulating housing protrude downward to form a fastening pillar respectively, the fastening feet and the fastening pillars are inserted in the circuit board to secure the electrical connector erectly on the circuit board.

11. The electrical connector as claimed in claim 7, wherein the top plate, the side plates and the bottom plate of the metal shell are die-cut inward to form a plurality of resisting arms.

12. An electrical connector adapted for being vertically assembled on a circuit board place levelly, comprising:

a first insulating housing having an erect base board and an erect tongue board extending forwards from a front of the base board;

a plurality of flat terminals each having a contact portion and a first soldering tail, the flat terminals being molded in the first insulating housing, the contact portions being exposed in a front of a right side of the tongue board and arranged at regular intervals along a vertical direction, the first soldering tails vertically projecting under the base board and being arranged at regular intervals along a front-to-rear direction;

a second insulating housing assembled to a right side of the base board of the first insulating housing;

a plurality of spring terminals each having a contact arm and a second soldering tail, the spring terminals being molded in the second insulating housing, the contact arms elastically projecting sideward out of the right side of the tongue board of the first insulating housing and being arranged at regular intervals along the vertical direction behind the contact portions of the flat terminals, the second soldering tails vertically projecting under the second insulating housing and being arranged at regular intervals along a front-to-rear direction; and a metal shell enclosing the first insulating housing and the second insulating housing, the first soldering tails of the flat terminals and the second soldering tails of the spring terminals further projecting under the metal shell to be inserted in the circuit board;

wherein the metal shell has a top plate, two side plates, a rear plate and a bottom plate, the rear plate is covered on backs of the first insulating housing and the second insulating housing, the bottom plate is connected between fronts of bottom edges of the side plates, the soldering tails of the flat terminals and the spring terminals project downward beyond the bottom plate through the back of the bottom plate; and wherein rears of the bottom edges of the side plates of the metal shell protrude downward to form a plurality of fastening feet, bottoms of the base board of the first insulating housing and the second insulating housing protrude downward to form a fastening pillar respectively, the fastening feet and the fastening pillars are inserted in the circuit board to secure the electrical connector erectly on the circuit board.

* * * * *